US009949511B2

(12) United States Patent
Liu

(10) Patent No.: US 9,949,511 B2
(45) Date of Patent: Apr. 24, 2018

(54) ELECTRONIC CIGARETTE AND CONTROL METHOD THEREFOR

(71) Applicant: Shenzhen Smoore Technology Limited, Shenzhen, Guangdong (CN)

(72) Inventor: Pingkun Liu, Guangdong (CN)

(73) Assignee: SHENZHEN SMOORE TECHNOLOGY LIMITED, Shenzhen (CN)

( * ) Notice: Subject to any disclaimer, the term of this patent is extended or adjusted under 35 U.S.C. 154(b) by 0 days.

(21) Appl. No.: 15/127,943

(22) PCT Filed: Jun. 24, 2014

(86) PCT No.: PCT/CN2014/080597
§ 371 (c)(1),
(2) Date: Sep. 21, 2016

(87) PCT Pub. No.: WO2015/196354
PCT Pub. Date: Dec. 30, 2015

(65) Prior Publication Data

US 2017/0095001 A1 Apr. 6, 2017

(51) Int. Cl.
*A24F 11/00* (2006.01)
*A24F 47/00* (2006.01)
*H05B 1/02* (2006.01)

(52) U.S. Cl.
CPC ..... *A24F 47/008* (2013.01); *A24F 47/00* (2013.01); *H05B 1/0244* (2013.01); *H05B 2203/021* (2013.01)

(58) Field of Classification Search
CPC ..... A24F 47/00
(Continued)

(56) References Cited

U.S. PATENT DOCUMENTS

2013/0192615 A1* 8/2013 Tucker ..... H01C 17/00 131/328
2015/0313284 A1* 11/2015 Liu ..... A24F 47/008 131/329
2015/0359264 A1* 12/2015 Fernando ..... A24F 47/008 131/328

FOREIGN PATENT DOCUMENTS

CN 102754913 A 10/2012
CN 102754924 A 10/2012
(Continued)

OTHER PUBLICATIONS

International Search Report, International application No. PCT/CN2014/080597. dated Mar. 23, 2015. SIPO, Beijing, China.

*Primary Examiner* — Abdullah Riyami
*Assistant Examiner* — Justin Kratt
(74) *Attorney, Agent, or Firm* — Coats & Bennett, PLLC

(57) ABSTRACT

An electronic cigarette and a control method thereof are provided. An electronic cigarette with a heating wire component used for producing heat, where the heating wire component comprises a heating wire having a resistance that varies with temperature; a power source used for providing the heating component with a voltage; and, a controller electrically coupled to the heating wire component and the power source and used for controlling the voltage outputted by the power source. The controller comprises a temperature detection module used for detecting the resistance of the heating wire and thus acquiring the actual temperature of the heating wire component. The temperature detection module presets an upper limit heating temperature and a lower limit heating temperature.

8 Claims, 4 Drawing Sheets

(58) Field of Classification Search
USPC ..... 131/328, 329
See application file for complete search history.

(56) References Cited

FOREIGN PATENT DOCUMENTS

| | | | |
|---|---|---|---|
| CN | 202722502 | U | 2/2013 |
| CN | 103404969 | A | 11/2013 |
| CN | 203643774 | U | 6/2014 |
| CN | 104116138 | A | 10/2014 |
| JP | 2949114 | B1 | 9/1999 |

* cited by examiner

ELECTRONIC CIGARETTE AND CONTROL METHOD THEREFOR

FIELD OF THE INVENTION

The present disclosure relates to electronic devices, and more particularly relates to an electronic cigarette and a control method thereof.

BACKGROUND OF THE INVENTION

An electronic cigarette is a battery powered electronic device that implements smoking effect by using inner detecting modules to detect airflow movements to determine whether it is at working status, and control a heating wire to vaporize tobacco liquid.

A conventional electronic cigarette uses a lithium battery having an initial voltage of 4.15V to 4.25V as a power source, and controls the power source to output the voltage by a micro controller, so that the heating wire produces heat. Such electronic cigarette usually applies two control modes: the first control mode is to output a constant voltage in a certain range, the voltage value of which may be 3.6V±0.15V or 3.4V±0.15V, and when the voltage of the lithium battery drops below 3.3V or 2.75V, the micro controller will control the power source to stop outputting voltage; the second control mode is to output the same voltage with the lithium battery, i.e. the working voltage applied to both ends of the heating wire is the same with the voltage of the lithium battery, and the voltage outputted by the power source drops along with the voltage of the lithium battery, and when the voltage of the lithium battery drops below 3.3V or 2.75V, the micro controller will control the power source to stop outputting voltage.

However, since the voltage applies to both ends of the heating wire is a constant voltage or varies only with the voltage of the lithium battery, the greater the smoking time is, the higher temperature the heating wire will be. When the temperature of the heating wire is higher than the vaporization temperature of the tobacco liquid, the tobacco liquid will be cracked and release burning smell. Moreover, since the lung capacity or smoking habit of individuals is different, if the output voltage is a constant voltage or varies with the voltage of the lithium battery, the variation of the temperature of the heating wire will be relatively large, causing an inconsistent flavor of the atomized tobacco liquid.

SUMMARY OF THE INVENTION

Accordingly, in order to address the problem of the burning smell caused by the high temperature of the heating wire and the inconsistent flavor caused by the unstable temperature of the heating wire, it is necessary to provide an electronic cigarette and a method of controlling the electronic cigarette to avoid producing burning smell, ensure the consistent flavor of each taste of the cigarette, and save the power.

An electronic cigarette includes: a heating wire component configured to produce heat, wherein the heating wire component includes a heating wire having a resistance that varies with temperature; a power source configured to provide a voltage to the heating wire component; and a controller electrically coupled to the heating wire component and configured to control the power source to output the voltage; wherein the controller includes a temperature detecting module configured to detect the resistance of the heating wire and obtain a real-time temperature of the heating wire component, the temperature detecting module presets an upper limit heating temperature and a lower limit heating temperature; when the real-time temperature is lower than or equals to the lower limit heating temperature, the controller controls the power source to output a first voltage; when the real-time temperature is higher than or equals to the upper limit heating temperature, the controller controls the power source to output a second voltage that is lower than the first voltage; and when the real-time temperature is higher than the lower limit heating temperature and lower than the upper limit heating temperature, the controller controls the power source to maintain a current output voltage.

In one of embodiments, the controller presets data of a correspondence between the real-time temperatures of the heating wire component and the resistances of the heating wire.

In one of embodiments, the variation of the resistance of the heating wire is obtained by detecting the voltage applied to both ends of the heating wire and the current runs through the heating wire.

In one of embodiments, the heating wire has a positive temperature coefficient, and the resistance of the heating wire increases with the increase of temperature.

In one of embodiments, the electronic cigarette further includes a tobacco liquid storing component configured to store tobacco liquid, wherein the upper limit heating temperature is lower than an upper limit vaporization temperature of the vaporized tobacco liquid, and the lower limit heating temperature is higher than a lower limit vaporization temperature of the vaporized tobacco liquid.

In one of embodiments, the electronic cigarette further includes a mouthpiece, wherein the controller further includes a smoking detecting module connected to the mouthpiece and a time detecting module electrically coupled to the smoking detecting module, the smoking detecting module is configured to detect a smoking action, the time detecting module presets a reference period and is configured to detect a duration of a single inhalation in the smoking action and compare the duration with the reference period, when the duration is greater than the reference period, the controller controls the power source to be shut down.

In one of embodiments, the controller further includes a residual tobacco liquid detecting module configured to detect a heating time required for heating the heating wire component from starting to reaching the upper limit heating temperature, the residual tobacco liquid detecting module presets a standard period, when the heating time is less than the standard period, the controller controls the power source to be shut down.

In one of embodiments, the electronic cigarette further includes an indicator light connected to the controller, wherein the controller controls the indicator light to show a normal working status and a tobacco liquid exhausting status.

A method of controlling an electronic cigarette includes: setting a lower limit heating temperature and an upper limit heating temperature; detecting a real-time temperature of a heating wire component and comparing the real-time temperature with the lower limit heating temperature and the upper limit heating temperature; applying a first voltage to both ends of the heating wire component when the real-time temperature is lower than or equals to the lower limit heating temperature; applying a second voltage to both ends of the heating wire component when the real-time temperature is higher than or equals to the upper limit heating temperature, wherein the second voltage is lower than the first voltage, and maintaining a current voltage applied to both ends of the heating wire component when the real-time temperature is higher than the lower limit heating temperature and lower than the upper limit heating temperature.

In one of embodiments, the method further includes: setting a standard period; detecting a heating time required for heating the heating wire component from starting to reaching the upper limit heating temperature, and comparing the heating time with the standard period; controlling the electronic cigarette to work normally when the heating time is greater than or equals to the standard period; and shutting down the electronic cigarette when the heating time is less than the standard period.

The electronic cigarette described above includes the temperature detecting module, and the controller controls the power source to output voltage according to the real-time temperature of the heating wire component, thus avoiding the burning smell caused by the high temperature of the heating wire. In addition, the temperature of the heating wire is controlled to fluctuate in a certain range, thus ensuring the consistent flavor of each taste of the cigarette, and saving the power of the power source.

DETAILED DESCRIPTION OF THE EMBODIMENTS

Figure 1:
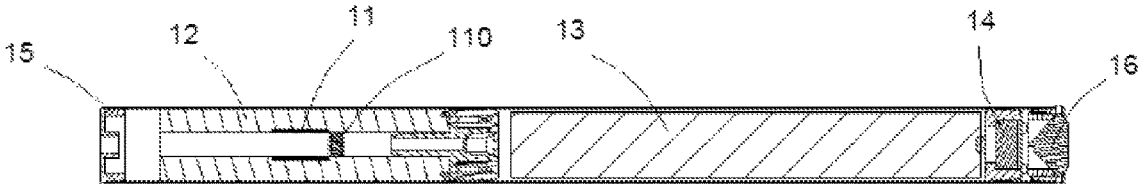
FIG. 1 is a cross-sectional view of an electronic cigarette in accordance with an embodiment.

FIG. 1 is a cross-section view of an electronic cigarette in accordance with an embodiment. The electronic cigarette includes a heating wire component 11, a tobacco liquid storing component 12, a power source 13, and a controller 14.

The heating wire component 11 is used to produce heat, and it includes a heating wire 110 having a resistance varies with temperature. In the illustrated embodiment, the material of the heating wire 110 includes metal cerium (Ce), and the resistance of the heating wire 110 increases with the increase of temperature.

The tobacco liquid storing component 12 is connected to the heating wire component 11 and configured to store tobacco liquid. The tobacco liquid has a lower limit vaporization temperature t1 and an upper limit vaporization temperature t2. In the illustrated embodiment, the lower limit vaporization temperature t1 is 190° C., while the upper limit vaporization temperature t2 is 220° C. When the temperature of the heating wire component 11 is between the lower limit vaporization temperature t1 and the upper limit vaporization temperature t2, the vaporized tobacco liquid has better taste, and thus the electronic cigarette can achieve a better smoking effect. However, when the temperature of the heating wire component 11 exceeds the upper limit vaporization temperature t2, the taste of the tobacco liquid will become worse. If the temperature of the heating wire component 11 continues to rise and reach 290° C., the tobacco liquid will be cracked and release a burning smell. In order to avoid producing the burning smell and keep the good taste of the electronic cigarette, it is necessary to maintain or slightly fluctuate the temperature of the heating wire component 11 between the minimum vaporize temperature t1 and the maximum vaporize temperature t2.

The power source 13 is configured to provide voltage to the heating wire component 11 and is electrically coupled to the controller 14. The controller 14 controls the power source 13 to output a first voltage U1 and a second voltage U2, and the second voltage U2 is lower than the first voltage U1. When the first voltage U1 is applied to both ends of the heating wire component 11, the temperature of the heating wire component 11 will rise; when the second voltage U2 is applied to both ends of the heating wire component 11, since the second voltage U2 is lower than the first voltage U1, and the second voltage U2 is low enough, the heating wire component 11 can continue to provide heat to the tobacco liquid without increasing its temperature. Along with the increase of the times of smoking the cigarette, the temperature of the heating wire component 11 under the second voltage U2 may drop, and in order to avoid the temperature of the heating wire component 11 decreasing to below the lower limit vaporization temperature t1, it is necessary to control the power source 13 to output the first voltage U1 again by the controller 14, so as to heat the heating wire component 11 again. In this manner, the temperature of the heating wire component 11 can be controlled by controlling the power source 13 to respectively output the first voltage U1 and the second voltage U2.

Figure 2:
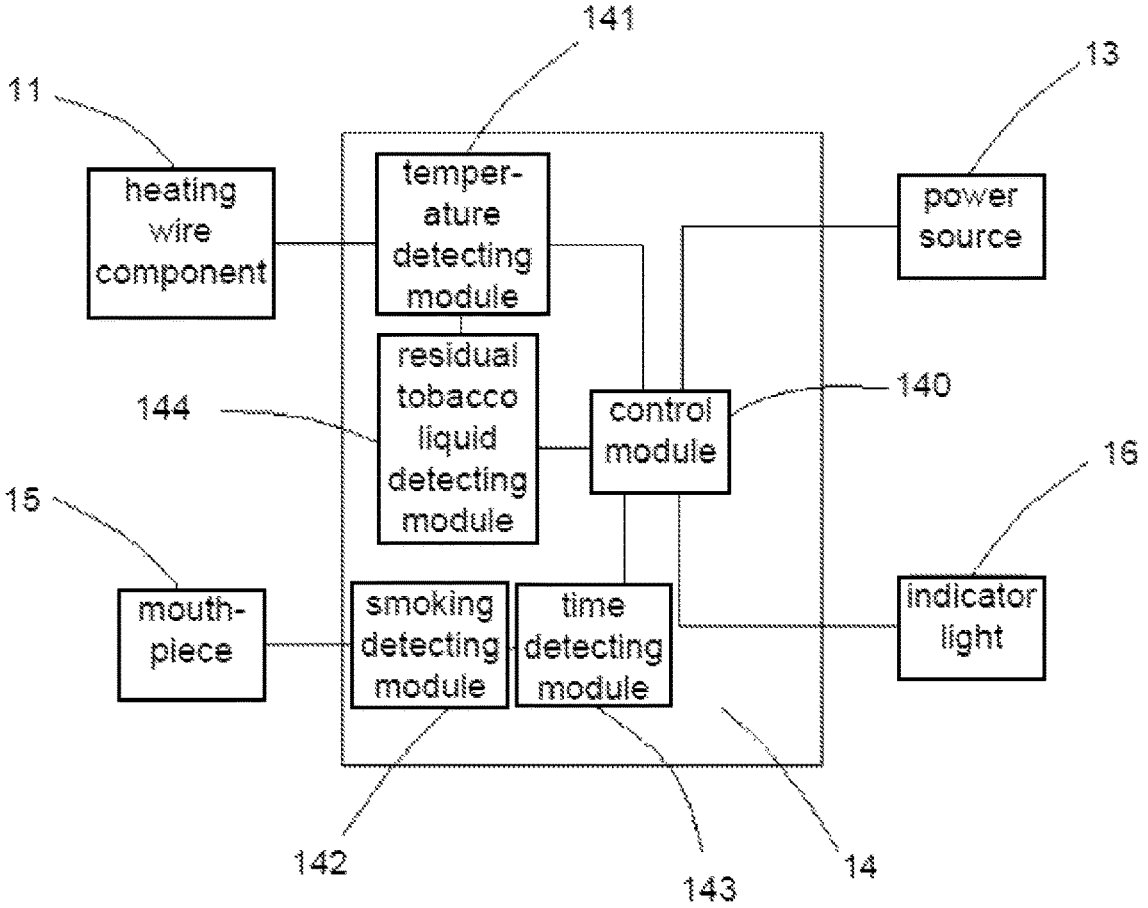
FIG. 2 is a block diagram of the electronic cigarette in accordance with an embodiment.

FIG. 2 is a block diagram of the electronic cigarette in accordance with an embodiment. The controller 14 includes a control module 140 configured to control the power source 13 to output voltages. The controller 14 presets data of a correspondence between real-time temperatures of the heating wire component 11 and resistances of the heating wire 110. The controller 14 further includes a temperature detecting module 141 electrically coupled to the heating wire component 11 and configured to detect the real-time temperature t0 of the heating wire component 11. The temperature detecting module 141 presets a lower limit heating temperature t3 and an upper limit heating temperature t4. Since there is a delay of the variation of the temperature of the heating wire component 11 after changing the voltage, the real-time temperature t0 will continue to increase or decrease, the lower limit heating temperature t3 is higher than the lower limit vaporization temperature t1, and the upper limit heating temperature t4 is lower than the upper limit vaporization temperature t2. When the real-time temperature t0 is lower than or equals to the lower limit heating temperature t3, the controller 14 controls the power source 13 to output the first voltage U1; when the real-time temperature t0 is higher than or equals to the upper limit heating temperature t4, the controller 14 controls the power source 13 to output the second voltage U2; and when the real-time temperature t0 is higher than the lower limit heating temperature t3 and lower than the upper limit heating temperature t4, the controller 14 controls the power source 13 to maintain a current output voltage.

Since controller 14 presets data of a correspondence between real-time temperatures of the heating wire component 11 and resistances of the heating wire 110, and the resistance of the heating wire 110 increases with the increase of temperature, the temperature detecting module 141 can determine the real-time temperature t0 of the heating wire component 11 by detecting, the resistance of the heating wire 110. The variation of the resistance of the heating wire 110 is obtained by detecting the voltage applied to both ends of the heating wire 110 and the current runs through the heating wire 110, therefore, it is very simple to sense the variation of temperature of the heating wire component 11 through the variation of the resistance of the heating wire 110. Preferably, the resistance of the heating wire 110 increases linearly with the increase of temperature, and the temperature detecting module 141 can rapidly determine the real-time temperature t0 of the heating wire component 11 by simply detecting the resistance of the heating wire 110, so that the controller 14 can rapidly control the power source 13 to output the voltage. Moreover, since the resistance of the heating wire 110 increases with the increase of temperature, and the amplitude of the increase is relatively large, i.e. when the temperature of the heating wire component 11 reaches the vaporization temperature of the tobacco liquid, the resistance of the heating wire 110 is relatively large, while the current running through the heating wire 110 is relatively low. Such feature helps to avoid a rapid increase of the temperature of the heating wire component 11, thus ensuring the temperature stabilization of the tobacco liquid. In an embodiment, for each 100° C. the temperature of the heating wire component 11 rises, the resistance value of the heating wire 110 will be increased by 0.10Ω to 0.80Ω. The amplitude of the increase can be adjusted by changing the formula of the heating wire 110.

Figure 3:
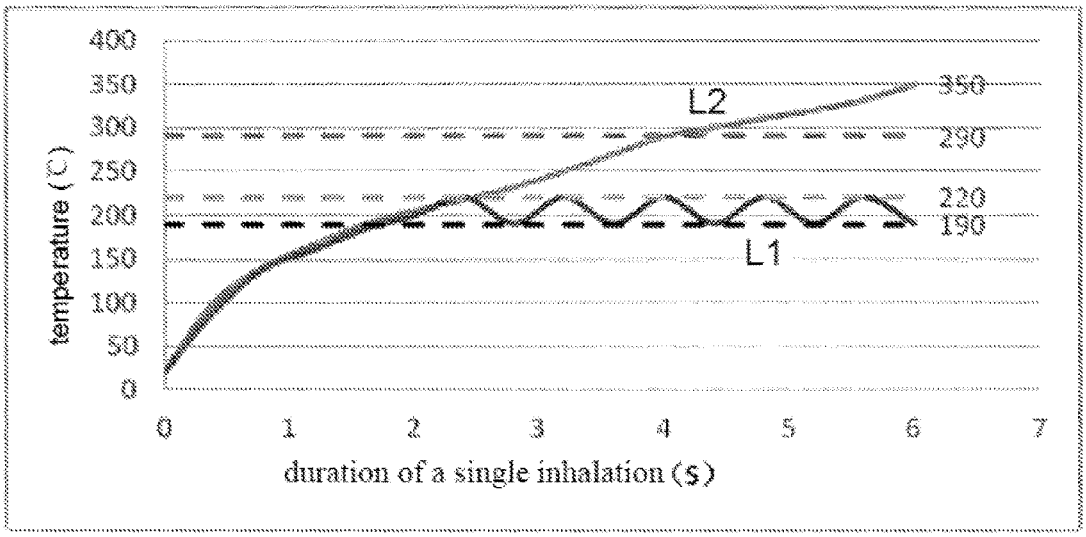
FIG. 3 is a diagram illustrating, for comparison, the temperature vs. time ratio characteristic curves of the heating wire component of the electronic cigarette according to the present disclosure and a conventional heating wire at normal working status.
Figure 4:
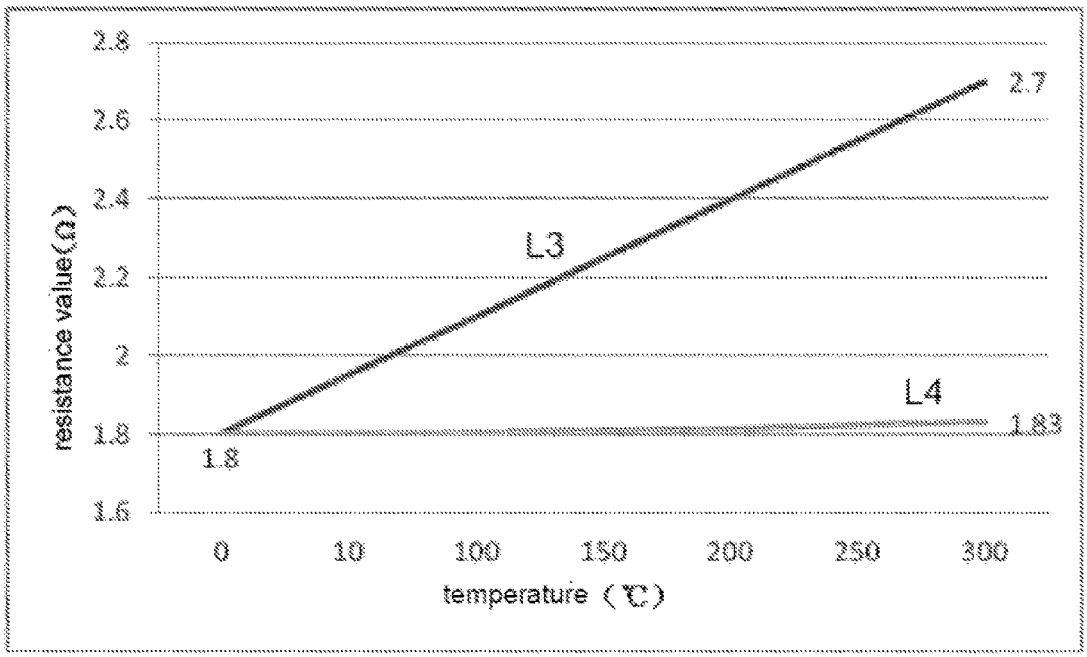
FIG. 4 is a diagram illustrating, for comparison, the resistance vs. temperature ratio characteristic curves of the heating wire component of the electronic cigarette according to the present disclosure and a conventional heating wire.

FIG. 3 is a diagram illustrating, for comparison, the temperature vs. time ratio characteristic curves of the heating wire component of the electronic cigarette according to the present disclosure and a conventional heating wire at normal working status. In FIG. 3, the curve L1 represents the variation curve of the temperature of the heating wire component 11 in the electronic cigarette of the present disclosure varies with time, while the curve L2 represents the variation curve of the temperature of a conventional heating wire component varies with time. FIG. 4 is a diagram illustrating, for comparison, the resistance vs. temperature ratio characteristic curves of the heating wire component of the electronic cigarette according to the present disclosure and a conventional heating wire. In FIG. 4, the curve L3 represents the variation curve of the resistance of the heating wire 110 in the electronic cigarette of the present disclosure varies with time, while the curve L4 represents the variation curve of the resistance of the heating wire component varies with time. The resistance of the conventional heating wire does not vary with the temperature, and if there is no temperature detecting module in the electronic cigarette, the temperature of the heating wire will continue to rise, and finally exceed the upper limit vaporization temperature of the tobacco liquid, thus causing a bad taste or even releasing burning smell. The resistance of the heating wire 110 in the electronic cigarette of the present disclosure increases linearly with the increase of temperature, and the temperature detecting module 141 is used to sense the temperature of the heating wire component 11, maintaining or slightly fluctuating the temperature of the heating wire component 11 between the lower limit vaporization temperature t1 and the upper limit vaporization temperature t2.

In an embodiment, the electronic cigarette further includes a mouthpiece 15, and the controller 14 further includes a smoking detecting module 142 connected to the mouthpiece 15 and a time detecting module 143 electrically coupled to the smoking detecting module 142. The smoking detecting module 142 is configured to detect a smoking action. The time detecting module 143 presets a reference period T0 and is configured to detect a duration T1 of a single inhalation in the smoking action. When the duration T1 is less than or equal to the reference period T0, the controller 14 determines that the user is smoking normally, and controls the power source 13 to output the voltage. When the duration T1 is greater than the reference period T0, the controller 14 determines that it is not a normal smoking action, and the controller 14 controls the power source 13 to be shut down. In the illustrated embodiment, the duration T1 of a single inhalation in the smoking action is used to determine whether the user is smoking or not, and the electronic cigarette is automatically shut down when the duration is too long, which is conducive to saving the power.

In an embodiment, the controller 14 further includes a residual tobacco liquid detecting module 144 electrically coupled to the temperature detecting module 141 and the control module 140, and is configured to detect a heating time T2 required for the heating wire component 11 to be heated from starting to reach the upper limit heating temperature t4. The residual tobacco liquid detecting module 144 presets a standard period T3, when the heating time T2 is less than the standard period T3, the controller 14 determines that the tobacco liquid is exhausted and controls the power source 13 to be shut down, and the power source 13 stops outputting voltage. Since the temperature of the heating wire component 11 will rapidly rise when little tobacco liquid left or the tobacco liquid is exhausted, it is conducive to protect the circuit by using the residual tobacco liquid detecting module 144 to detect the rising speed of the temperature of the heating wire component 11 and shutting down the power source 13 when the rising speed is too fast.

In an embodiment, the electronic cigarette further includes an indicator light 16 connected to the controller 14. The controller 14 controls the indicator light 16 to show a normal working status and a tobacco liquid exhausting status by the control module 140.

Since the electronic cigarette includes the temperature detecting module 141, and the controller 14 controls the power source 13 to output voltage according to the real-time temperature of the heating wire component 11, the burning smell caused by the high temperature of the heating wire component 11 is avoided. Simultaneously, the temperature of the heating wire is controlled to fluctuate in a certain range, thus ensuring the consistent flavor of each taste of the cigarette, and saving the power of the power source.

A method of controlling an electronic cigarette is also provided in the present disclosure.

Figure 5:
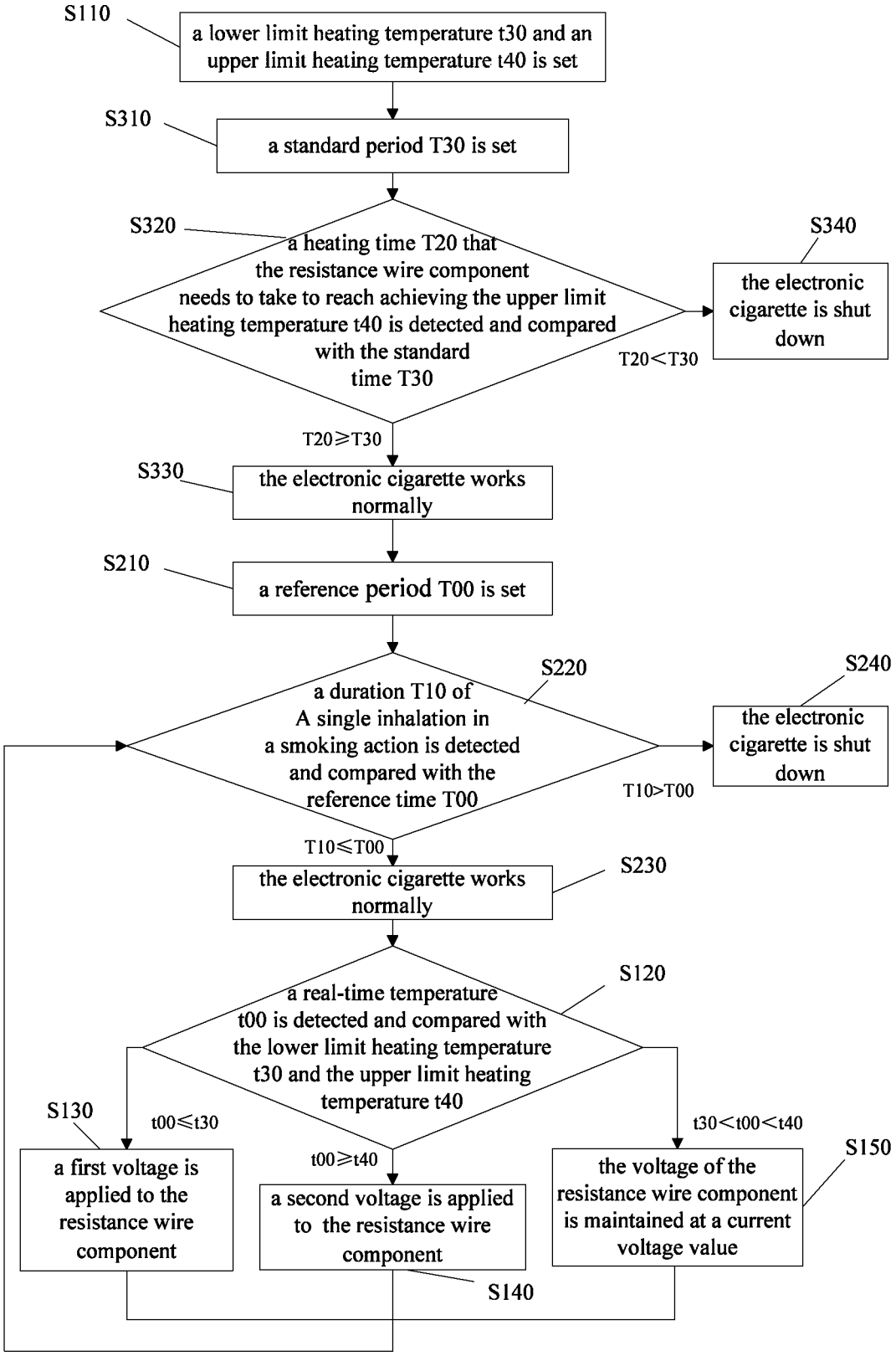
FIG. 5 is a flow chart of the control method of the electronic cigarette in accordance with an embodiment.

FIG. 5 is a flow chart of the method of controlling the electronic cigarette. The method includes the following steps.

In step S110, a lower limit heating temperature t30 and an upper limit heating temperature t40 are set.

In step S120, a real-time temperature t00 of a heating wire component is detected and compared with the lower limit heating temperature t30 and the upper limit heating temperature t40.

In step S130, when the real-time temperature t00 is lower than or equals to the lower limit heating temperature t30, a first voltage is applied to both ends of the heating wire component.

In step S140, when the real-time temperature t00 is higher than or equals to the upper limit heating temperature t40, a second voltage is applied to both ends of the heating wire component. The second voltage is lower than the first voltage.

In step S150, when the real-time temperature t00 is higher than the lower limit heating temperature t30 and lower than the upper limit heating temperature t40, the voltage applied to both ends of the heating wire component is maintained at a current voltage value.

In an embodiment, prior to detecting the real-time temperature t00 and comparing the real-time temperature t00 with the lower limit heating temperature t30 and the upper limit heating temperature t40, the method further includes the following steps.

In step S210, a reference period T00 is set.

In step S220, a smoking action and a duration T10 of a single inhalation in the smoking action is detected, and the duration T10 is compared with the reference period T00.

In step S230, the electronic cigarette is controlled to work normally when the duration T10 is less than or equals to the reference period T00.

In step S240, the electronic cigarette is shut down when the duration T10 is greater than the reference period T00.

In an embodiment, prior to setting the reference period T00, the method further includes the following steps.

In step S310, a standard period T30 is set.

In step S320, a heating time T20 required for heating the heating wire component from starting to reach the upper limit heating temperature t40 is detected and compared with the standard period T30.

In step S330, the electronic cigarette is controlled to work normally when the heating time T20 is greater than or equals to the standard period T30.

In step S340, the electronic cigarette is shut down when the heating time T20 is less than the standard period T30.

In the present control method, the output voltage of the power source is adjusted by detecting the temperature of the heating wire component, avoiding the burning smell caused by the high temperature of the heating wire, and ensuring the flavor of each taste of the cigarette by making the temperature of the heating wire fluctuate in a certain range; the rising speed of the temperature of the heating wire component is detect and the power source is shut down when the rising speed is too fast, protecting the circuit; and the smoking action and the duration of a single inhalation are detected, and the electronic cigarette automatically shuts down when the duration is too long, saving the power of the power source.

The embodiments described above only show a few implement manners of the present invention, the description is specific and detailed, but it cannot be interpreted as a limitation of the range of the present invention. What should be pointed out is that it is apparent to those skilled in the art that a variety of modifications and changes may be made without departing from the scope of the present invention. Thus, the range of the present invention should be defined by the appended claims.

What is claimed is:

1. An electronic cigarette, comprising:

a heating wire component configured to produce heat, wherein the heating wire component comprises a heating wire having a resistance that varies with temperature;

a power source configured to provide a voltage to the heating wire component; and a controller electrically coupled to the heating wire component and configured to control the power source to output the voltage;

wherein the controller comprises a temperature detecting module configured to detect the resistance of the heating wire and obtain a real-time temperature of the heating wire component, the temperature detecting module presets an upper limit heating temperature and a lower limit heating temperature; when the real-time temperature is lower than or equals to the lower limit heating temperature, the controller controls the power source to output a first voltage; when the real-time temperature is higher than or equal to the upper limit heating temperature, the controller controls the power source to output a second voltage that is lower than the first voltage; and when the real-time temperature is higher than the lower limit heating temperature and lower than the upper limit heating temperature, the controller controls the power source to maintain a current output voltage;

wherein the controller further comprises a residual tobacco liquid detecting module configured to detect a heating time required for heating the heating wire component from starting to reach the upper limit heating temperature, the residual tobacco liquid detecting module presets a standard period, when the heating time is less than the standard period, the controller controls the power source to be shut down.

2. The electronic cigarette according to claim 1, wherein the controller presets data of a correspondence between the real-time temperatures of the heating wire component and the resistances of the heating wire.

3. The electronic cigarette according to claim 2, wherein the variation of the resistance of the heating wire is obtained by detecting the voltage applied to both ends of the heating wire and the current that runs through the heating wire.

4. The electronic cigarette according to claim 3, wherein the heating wire has a positive temperature coefficient, and the resistance of the heating wire increases with the increase of temperature.

5. The electronic cigarette according to claim 1, further comprising a tobacco liquid storing component configured to store tobacco liquid, wherein the upper limit heating temperature is lower than an upper limit vaporization temperature of the tobacco liquid, and the lower limit heating temperature is higher than a lower limit vaporization temperature of the tobacco liquid.

6. The electronic cigarette according to claim 1, further comprising a mouthpiece, wherein the controller further comprises a smoking detecting module connected to the mouthpiece and a time detecting module electrically coupled to the smoking detecting module, the smoking detecting module is configured to detect a smoking action, the time detecting module presets a reference period and is configured to detect a duration of a single inhalation in the smoking action and compare the duration with the reference period, when the duration is greater than the reference period, the controller controls the power source to be shut down.

7. The electronic cigarette according to claim 6, further comprising an indicator light connected to the controller, wherein the controller controls the indicator light to show a working status and a tobacco liquid exhausting status.

8. A method of controlling an electronic cigarette, comprising:

setting a lower limit heating temperature and an upper limit heating temperature;

detecting a real-time temperature of a heating wire component and comparing the real-time temperature with the lower limit heating temperature and the upper limit heating temperature;

applying a first voltage to both ends of the heating wire component when the real-time temperature is lower than or equals to the lower limit heating temperature;

applying a second voltage to both ends of the heating wire component when the real-time temperature is higher than or equals to the upper limit heating temperature, wherein the second voltage is lower than the first voltage;

maintaining a current voltage applied to both ends of the heating wire component when the real-time temperature is higher than the lower limit heating temperature and lower than the upper limit heating temperature;

setting a standard period;

detecting a heating time required for heating the heating wire component from starting to reaching the upper limit heating temperature, and comparing the heating time with the standard period;

controlling the electronic cigarette to work normally when the heating time is greater than or equals to the standard period; and shutting down, the electronic cigarette when the heating time is less than the standard period.

* * * * *